US010151053B2

(12) United States Patent
Izumi et al.

(10) Patent No.: US 10,151,053 B2
(45) Date of Patent: Dec. 11, 2018

(54) PROCESS AND APPARATUS FOR EXPANDING MULTIPLE FILAMENT TOW

(71) Applicant: Izumi International, Inc., Greenville, SC (US)

(72) Inventors: Ryutaro Izumi, Simpsonville, SC (US); Mark Takahama, Greenville, SC (US)

(73) Assignee: IZUMI INTERNATIONAL, INC., Greenville, SC (US)

( * ) Notice: Subject to any disclaimer, the term of this patent is extended or adjusted under 35 U.S.C. 154(b) by 274 days.

(21) Appl. No.: 15/287,401

(22) Filed: Oct. 6, 2016

(65) Prior Publication Data

US 2018/0100251 A1 Apr. 12, 2018

(51) Int. Cl.

| | |
|---|---|
| ***D02J 1/18*** | (2006.01) |
| ***D01D 11/02*** | (2006.01) |
| ***D02J 1/22*** | (2006.01) |

(52) U.S. Cl.

CPC ..... *D02J 1/18* (2013.01); *D01D 11/02* (2013.01); *D02J 1/22* (2013.01)

(58) Field of Classification Search

CPC ..... D02J 1/18; D02J 1/20; D02J 1/22; D02J 1/225; D02J 1/16; D02J 11/00; D01D 11/02; D06C 3/06; D06C 3/062; B65H 51/005; B65H 51/08; B65H 51/12; B65H 51/04; B65H 51/02; B65H 57/02; B65H 57/16; B65H 57/00; B65H 57/14; D01G 5/00; D01G 9/00

USPC ..... 28/282; 19/65 T; 26/90, 99

See application file for complete search history.

(56) References Cited

U.S. PATENT DOCUMENTS

| | | | | | |
|---|---|---|---|---|---|
| 259,036 | A * | 6/1882 | Miller | B25B 5/04 | 26/90 |
| 1,728,682 | A * | 9/1929 | Kampf | D01B 9/00 | 28/282 |
| 3,708,832 | A * | 1/1973 | Lohrke | D01G 99/00 | 28/282 |
| 3,961,396 | A * | 6/1976 | Lubitzsch | D01D 11/02 | 19/65 T |
| 4,422,225 | A * | 12/1983 | Kurzke | B65H 54/76 | 28/289 |
| 4,959,895 | A * | 10/1990 | Sager | B65H 51/005 | 228/1.1 |
| 5,042,122 | A * | 8/1991 | Iyer | B05C 9/14 | 19/0.46 |
| 5,101,542 | A * | 4/1992 | Nakagawa | B65H 51/005 | 19/65 T |
| 5,781,973 | A * | 7/1998 | Orzel | B65H 23/0208 | 26/105 |
| 6,049,956 | A * | 4/2000 | Lifke | B65H 51/005 | 19/65 T |
| 6,743,392 | B2 * | 6/2004 | Tanaka | B29B 15/122 | 264/136 |
| 2006/0085958 | A1 * | 4/2006 | Oishibashi | B65H 51/005 | 28/282 |
| 2010/0107384 | A1 * | 5/2010 | Meyer | D02J 1/18 | 28/282 |
| 2014/0069073 | A1 * | 3/2014 | Dominguez | F16D 69/023 | 57/2.3 |

* cited by examiner

*Primary Examiner* — Amy Vanatta
(74) *Attorney, Agent, or Firm* — Nexsen Pruet, LLC; John B. Hardaway, III

(57) ABSTRACT

A process and apparatus for spreading a multiple filament tow by passing the tow through a series of rotating discs having asymmetrical rollers mounted thereon.

8 Claims, 4 Drawing Sheets

PROCESS AND APPARATUS FOR EXPANDING MULTIPLE FILAMENT TOW

CROSS-REFERENCE TO RELATED APPLICATIONS

None.

BACKGROUND OF THE INVENTION

This invention relates generally to the field of reinforcing fibers and more particularly to a process and apparatus for spreading a multiple filament tow into a spread web by subjecting the multiple filament tow to a cyclical high velocity impact with the spreading rollers which result in spreading of the tow band.

In the composites industry, a tow is an untwisted bundle of continuous filaments, and it refers to man-made fibers, particularly carbon fibers. Tows are designated by the number of fibers they contain. For example, a 12K tow contains about 12,000 fibers. Multiple filament tows are often used for producing fiber reinforced plastic materials. Examples of such fibers are carbon, glass, and aramids. Such fibers have low mass and a relatively high tensile strength in their longitudinal direction. These fibers are often embedded in a plastic matrix with a matrix resin for producing such products as golf clubs, fishing rods, automotive components, and aeronautical applications.

Such fibers are generally supplied from the manufacturer in the form of multiple filament tows which are wound into a spool for handling on traditional textile equipment.

It has been found desirable to lessen the density of such tows for ease of resin impregnation, lessen expense by utilizing heavier tows and spreading to result in similar products obtained by lighter tows, and produce thinner density materials to reduce weight materials. Various prior art devices and processes have been carried out for spreading such tows to reduce the density thereof

SUMMARY OF THE INVENTION

This invention is directed to a process of spreading a multiple filament tow so as to both reduce the density and the costs thereof per unit of area. Conventional methods for spreading fiber involve running the fibers over multiple stationary spreading bars, generating high tensions during the process. However, for delicate fibers such as carbon fiber, the high tension and friction generated during the process result in broken filaments which degrade the properties of the carbon fiber. This new process is carried out with a unique apparatus which subjects the tow to a high speed, high frequency contact between the tow and rollers causing the tow to spread. The relatively low tension required in this process prevents excessive damage to the filaments while the cyclical impact between the rollers and tow induce the spreading effect.

The tow to be spread is passed through a series of rotating discs which are driven in unison and each of which have four rollers thereon about which the tow progresses. The rollers located on the disc are concentrically located about two separate diameters such that the distance between the first and third roller is greater than the distance between the second and fourth roller. Additionally, the rollers of adjacent discs are offset from one another by up to 90°. This offset is responsible for the periodical slack generated of the tow passing there through, which produces the cyclical high impact contact between the roller and the tow. The inlet tension is controlled by a tensioning creel having a spool thereon from which the tow is unwound. Additional tension and vibration control is brought about by dancing rollers which can be either free rolling or load bearing.

Various other advantages and features of this invention will be apparent from the following detailed description given with reference to the various figures of drawing.

DETAILED DESCRIPTION

According to this invention, it has been found that a multiple filament tow may be spread to lower the density and unit cost by a unique process carried out by the apparatus of this invention.

Figure 1:
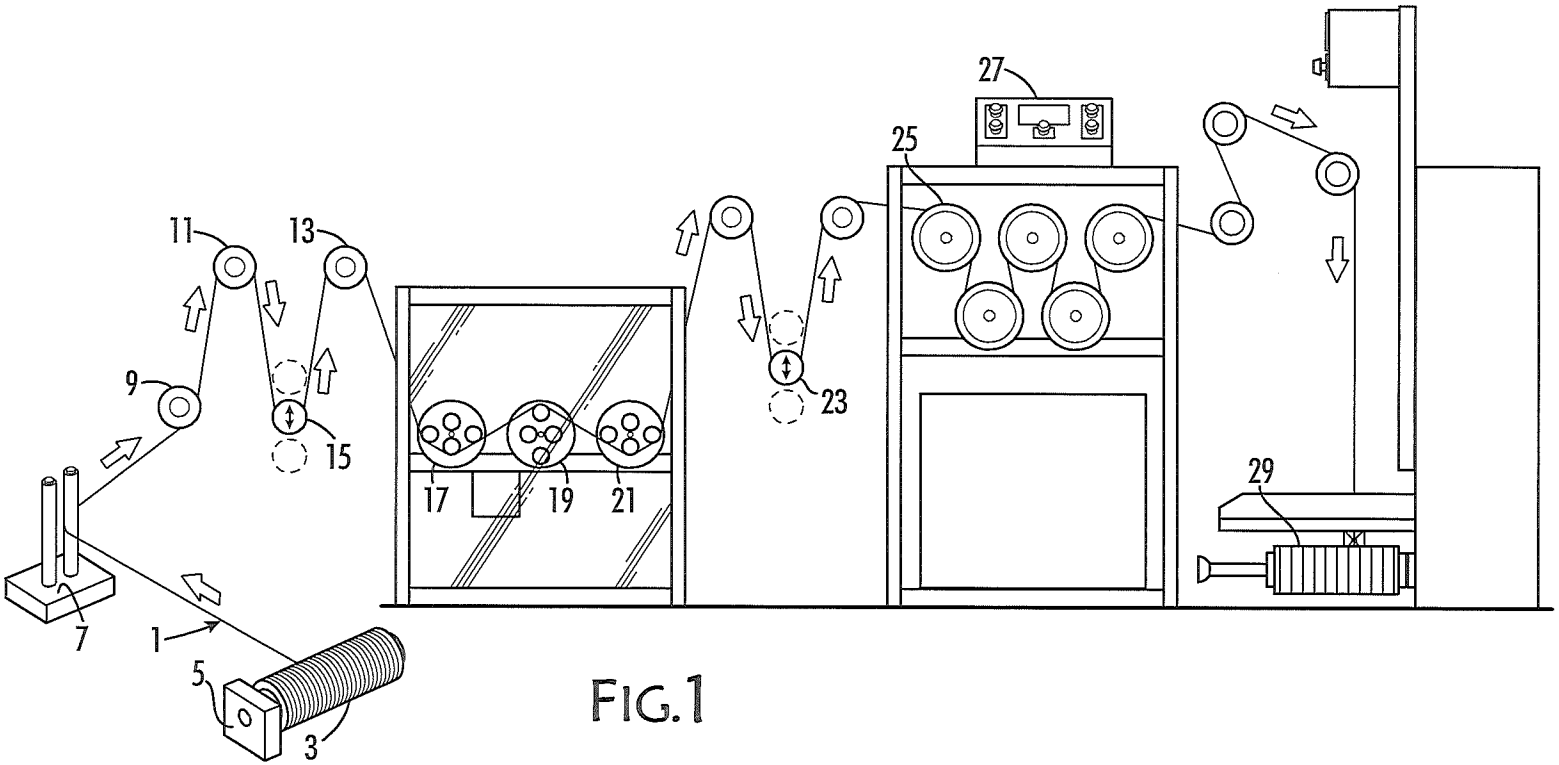
FIG. 1 schematically illustrates the process and apparatus of this invention.

FIG. 1 of the drawings generally illustrates the process and schematically illustrates the apparatus for carrying out the process. A multiple filament tow 1 is generally unwound from a spool 3 having the multiple filament tow 1 wound thereabout. The spool 3 is associated with a tensioning creel 5 that controls the tension in a manner known to the art. Such tensioning creels are available from Izumi International as their ST Series creels. Multiple filament tow 1 is fed through centering bars 7 so as to position the tow 1 for feeding to a series of freely rotating rollers 9, 11 and 13. Positioned between rollers 11 and 13 is a dancing roller 15 positioned to dampen any vibration associated with movement of the tow 1 and generally in association with the tensioning roll 5 control the tension in the tow 1 at that point in the process. The dancing roll 15 may be either a spring loaded dancer or air based vacuum dancer.

The tow 1 is then fed to a series of driven discs 17, 19, and 21. These discs will be further discussed infra. Upon leaving the last disc 21 the tow is subject to additional tension control by dancing roller 23. The dancing rollers 15 and 23 have illustrated in phantom the amplitudes of movement associated with the damping activity. The tow 1 is pulled through a series of driven rollers 25 which pull the tow 1 through the rotating discs and associated rollers. A speed controller 27 controls the speed of the driven rollers 25. At this point the multi-filament tow has been spread to a desired degree and is thus wound upon a take-up winder for removal and further processing.

Figure 2A:
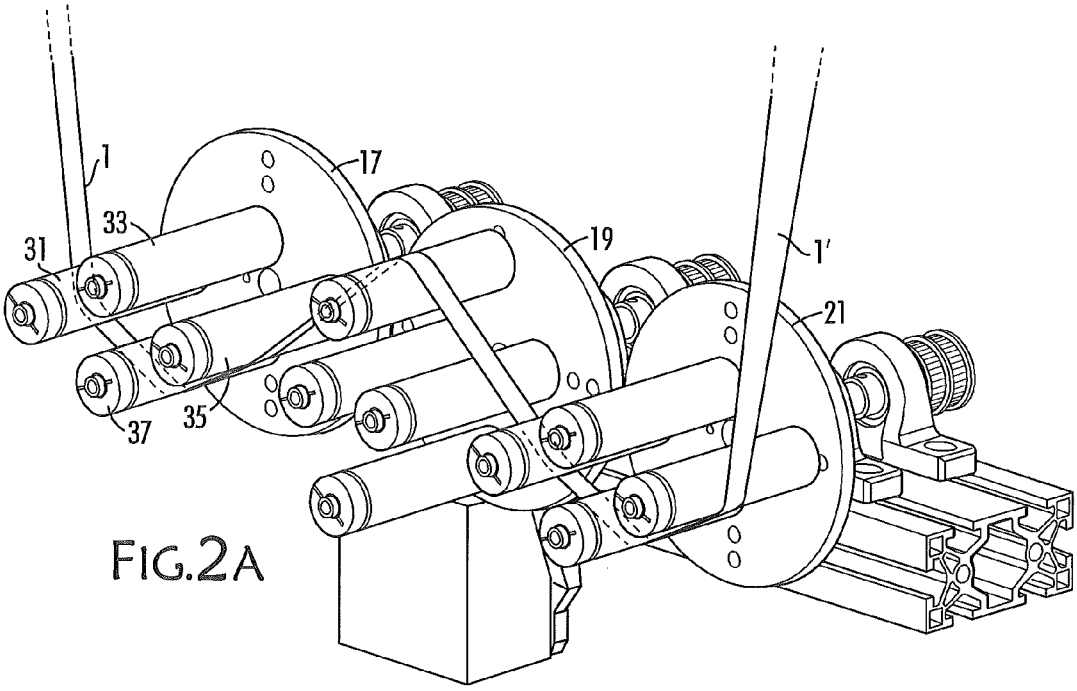
FIG. 2A is a perspective detailed views of the discs illustrated in FIG. 1.

Referring to FIG. 2A of the drawings which illustrates the rotating discs 17, 19, and 21 in further detail, it is seen that each disc has located thereon four rollers. These rollers are generally identical and will be described with reference to the rollers appearing on disc 17. Disc 17 has located thereon a first roller 31, a second roller 33, a third roller 35, and a fourth roller 37. It should be noted that these rollers are located on two concentric circles with different diameters thus the distance between the first roller 31 and the third roller 35 is greater than that between the second roller 33 and the fourth roller 37.

Referring to disc 19 which is adjacent to disc 17 and disc 21, disc 19 offset from the position of the adjacent rollers by 90°. This amount of offset may be varied between zero and 90° with the greater spreading effect occurring at 90°.

Figure 2B:
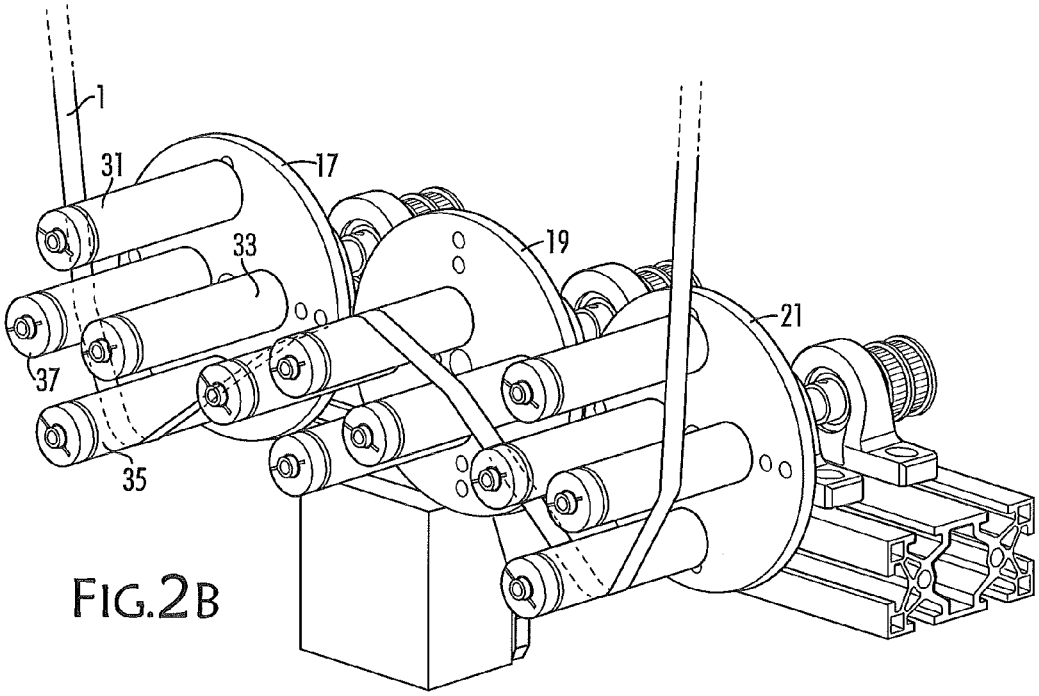
FIG. 2B is a perspective detailed similar to FIG. 2A with the discs rotated 90° from the FIG. 2A view.

FIG. 2B is similar to FIG. 2A in that it illustrates the same disc and rollers but with the discs having been rotated 90°. In this position the offset between adjacent rollers remains the same. It is this offset and the asymmetry of the rollers which produce the tensioning and relaxation effects upon the multifilament tow 1.

It can be appreciated that multiple discs may be provided to carry out the process of this invention. The greater the number of discs, the greater the spreading effect. Additionally, the rollers 31, 33, 35, and 37 may be free to rotate, or may be locked in position to add a greater tensioning effect upon multi-filament tow 1. It should be noted that once the multiple filament tow 1 has passed through all of the discs and rollers, that a spread multi-filament tow 1' is the resulted product.

Figure 3A:
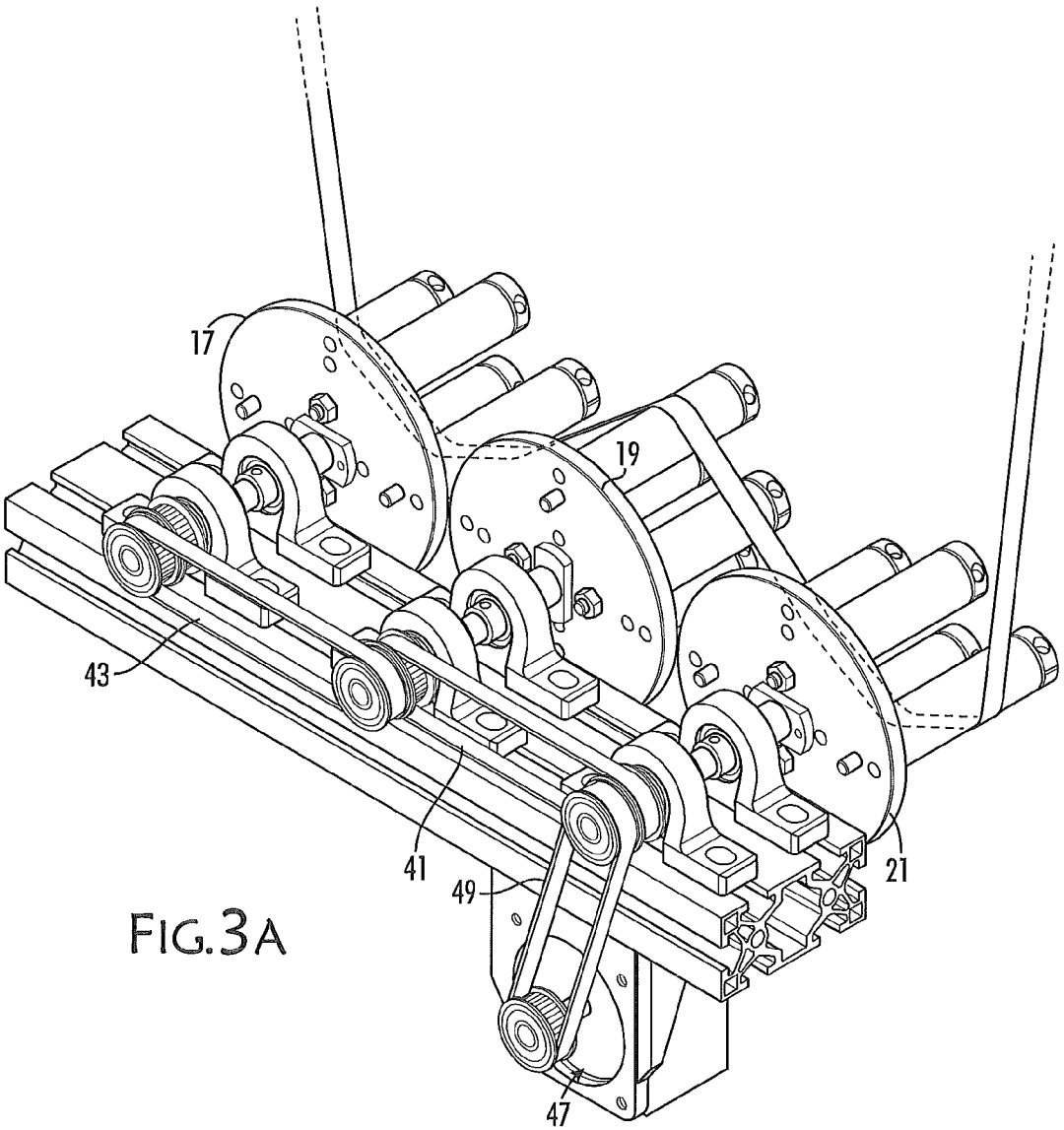
FIG. 3A is a reverse perspective detailed view of the discs illustrated FIGS. 2A.
Figure 3B:
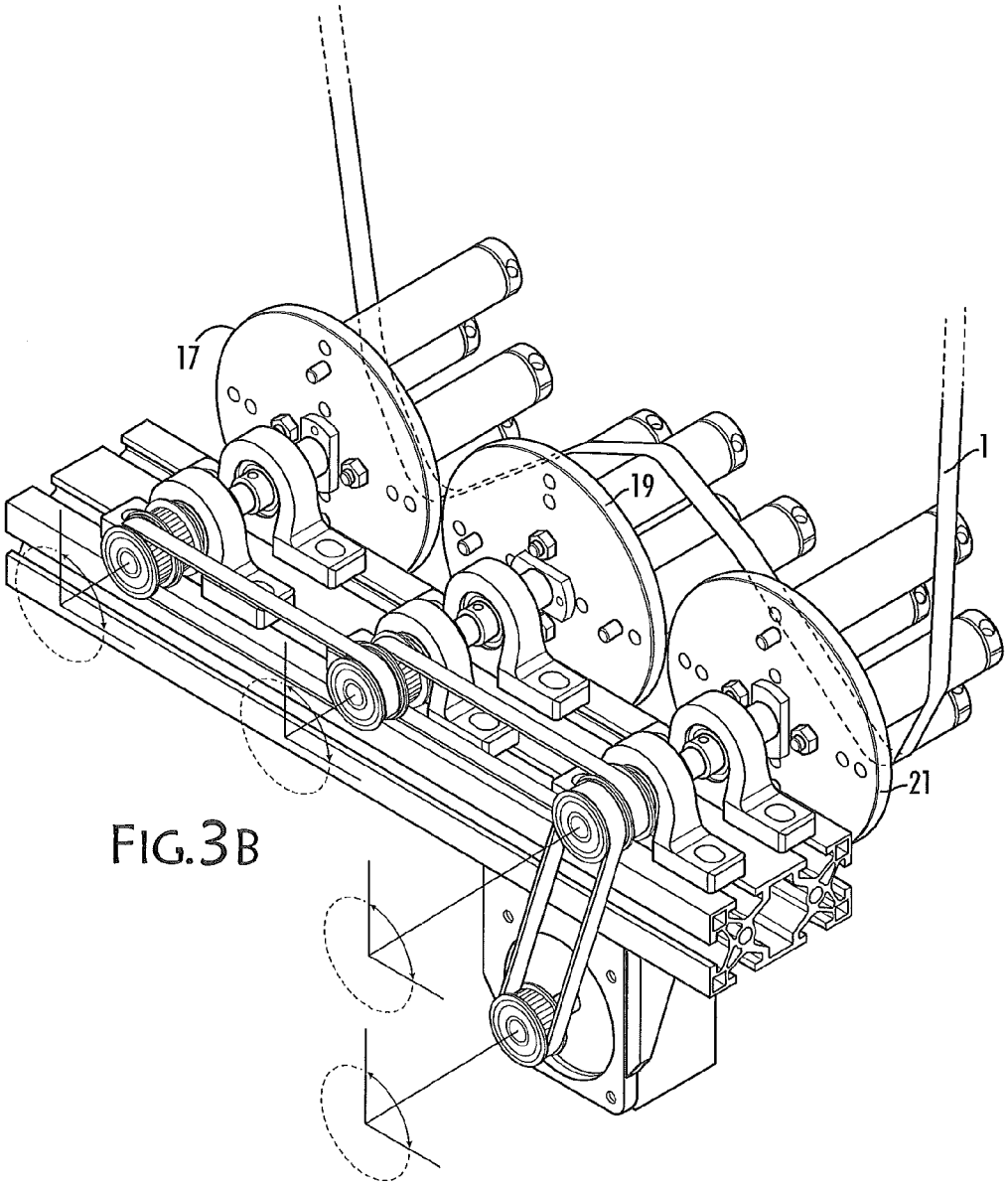
FIG. 3B is a view similar to FIG. 3A with the discs rotated 90° from the FIG. 3A view.

Referring to FIGS. 3A and 3B, it is noted that these figures are the reverse side of the position of the discs illustrated in FIGS. 2A and 2B. The discs 17, 19, and 21 are driven by timing belts 41 and 43. A drive motor 47, 45 drives the timing belts 49 to supply power to drive the timing belts 41 and 43.

FIG. 3B is similar to FIG. 3A but differs in that the positioning of the adjacent disc has been rotated by 90° as shown by the phantom arrows. It is thus seen that the process and apparatus of this invention provide a unique spread multiple filament tow in a simple and efficient manner. As the foregoing description has been exemplary in nature, it is to be construed by the spirit and scope of the following appended Claims.

What is claimed is:

1. A process for spreading a multiple filament tow wound into a spool comprising the steps of:

providing a multiple filament spool to a tensioning creel;

winding a tow from said spool through a series of rotating discs, each disc having four rotating rollers thereon, the rollers located on two concentric circles with different diameters, wherein the rollers are asymmetrically positioned on each disc such that the distance between the first and third roller is greater than the distance between the second and fourth roller, each disc having rollers which are offset from the rollers of an adjacent disc by up to 90°;

pulling said tow through said rotating discs to spread said tow into a spread tow; and winding said spread tow onto a take-up winder to form a spread tow spool.

2. A process according to claim 1 wherein said rollers rotate freely.

3. The process according to claim 1 wherein said rollers are locked in position.

4. The process according to claim 1 wherein during said step of pulling, said tow is subjected to alternating periods of tension and slack as said tow passes through said rotating discs, generating cyclical high velocity impact with the rollers.

5. The process according to claim 1 wherein said multiple filament tow is formed from carbon fibers.

6. An apparatus for spreading a multiple filament tow comprising:

a tensioning creel having a multiple filament tow thereon;

centering bars for positioning said tow;

a series of rollers for receiving said tow from said centering bars;

a dancing roller within said series of rollers to dampen vibration of said tow;

a series of rotating discs;

each disc of said series of discs having four rollers thereon, the rollers located on two concentric circles with different diameters, wherein the rollers are asymmetrically positioned on each disc such that the distance between the first and third roller is greater than the distance between the second and fourth roller;

each disc having rollers which are offset from the rollers of an adjacent disc by up to 90°;

a series of driven rollers for pulling said tow through said series of rotating discs; and a take-up winder for winding said tow in a spread state thereon.

7. The apparatus according to claim 6 further comprising a drive motor for rotating said discs.

8. The apparatus according to claim 6 comprising timing belts connecting the series of rotating discs for synchronously imparting rotational motion thereto.

* * * * *